US005285671A

United States Patent [19]

Del Fabro et al.

[11] Patent Number: 5,285,671

[45] Date of Patent: Feb. 15, 1994

[54] BENDING-SHAPING MACHINE HAVING MULTIPLE WORKING LEVELS

[75] Inventors: Giorgio Del Fabro, Cassacco-Fraz.Montegnacco; Marcello Del Fabro, Udine, both of Italy

[73] Assignee: M.E.P. Macchine Elettronichi Piegatrici SpA, Reana Del Rojale

[21] Appl. No.: 945,888

[22] Filed: Sep. 17, 1992

[30] Foreign Application Priority Data

Oct. 21, 1991 [IT] Italy ..... UD91A000174

[51] Int. Cl.[5] ..... B21D 7/024; B21D 43/08

[52] U.S. Cl. ..... 72/294; 72/307; 72/217

[58] Field of Search ..... 72/294, 307, 446, 447, 72/217-219, 226, 131, 129

[56] References Cited

U.S. PATENT DOCUMENTS

| | | | |
|---|---|---|---|
| 3,777,531 | 12/1973 | McClain | 72/226 |
| 3,991,600 | 11/1976 | Del Fabro | 72/217 |
| 4,248,273 | 2/1981 | Marcello | 72/217 |
| 4,660,399 | 4/1987 | Suter | 72/181 |
| 5,099,669 | 3/1992 | Del Fabro | 72/217 |
| 5,195,348 | 3/1993 | Del Fabro | 72/294 |

FOREIGN PATENT DOCUMENTS

| | | | |
|---|---|---|---|
| 0015354 | 5/1979 | European Pat. Off. . | |
| 0379030 | 1/1989 | European Pat. Off. . | |
| 0379043 | 1/1989 | European Pat. Off. . | |
| 3316917 | 11/1984 | Fed. Rep. of Germany | 72/307 |

*Primary Examiner*—Daniel C. Crane

*Attorney, Agent, or Firm*—Antonelli, Terry, Stout & Kraus

[57] ABSTRACT

Bending-shaping machine for sections with a bending unit (12) located downstream of an assembly (14) that draws and/or straightens sections (15), a shearing unit (11) being interposed, in which machine a drawing unit (13) is comprised downstream of the bending unit (12) and on the same axis as the section (15) and has a first normal working position (13N) and a second downwardly retracted position (13S), the bending unit (12) having a third raised working position (12A) with a section (15) positioned above the shearing unit (11) and above the assembly 14) that draws and/or straightens sections (15).

9 Claims, 4 Drawing Sheets

BENDING-SHAPING MACHINE HAVING MULTIPLE WORKING LEVELS

BACKGROUND OF THE INVENTION

This invention concerns a bending-shaping machine having multiple working levels.

The bending-shaping machine of this invention is applied properly to the field of processing sections for reinforced concrete, whether those sections are obtained from straight bars or wound rolls and whether the sections have a round, square, polygonal or other cross section.

The bending-shaping machine to which the invention is applied has a vertical or almost vertical or, in any event, inclined working surface, and the working surface can often be oriented from the horizontal to the vertical.

To be more exact, the bending-shaping machine according to the invention performs the bending of steel bars for building work and is especially suitable to bend long steel bars or complex stirrups.

Considerable difficulties are encountered in bending complex stirrups and steel bars of a great length with bending-shaping machines.

In fact with the bending-shaping machines of the state of the art it is impossible to bend the trailing end of complex stirrups without these complex stirrups coming into contact during processing with the shearing unit or with the drawing and/or straightening assembly located upstream of the bending unit.

In the same way it is impossible to make certain bends in the trailing ends of long steel bars since the bars come into contact with the shearing unit or with the drawing and/or straightening assembly located upstream of the bending unit of the bending-shaping machine.

This fact restricts the production capacity of the bending-shaping machines of the state of the art considerably.

IT 15904 A/89 discloses a bending-shaping machine with a shearing unit which can be retracted below the working surface, so that bends can also be made in complex stirrups and long steel bars. This movement of retraction of the shearing unit can be achieved with complex mechanisms which require burdensome maintenance work and difficulties in installation and setting-up and relatively long cycle times.

IT 83543 A/90 discloses a bending-shaping machine which is the basis of this invention. This bending-shaping machine entails the drawback that the bends in the trailing ends of sections have to have a modest length. The present applicants have designed, tested and embodied this invention to obviate the shortcomings of the state of the art and to achieve further advantages.

SUMMARY OF THE INVENTION

This invention consists in providing the bending-shaping machine of IT 83543 A/90 with multiple working levels, which enable steel bars for building work to be produced with any shape and length and without these steel bars coming into contact, during the bending steps, with the shearing unit or with the drawing and/or straightening assembly.

In particular, this invention enables bends to be made in the trailing end of complex stirrups and long steel bars without the stirrups and bars coming into contact with the shearing unit or with the drawing and/or straightening assembly of the bending-shaping machine.

Moreover, the bending-shaping machine of this invention makes possible less care by the machine operator, operating facility and therefore shorter cycle times.

According to a first embodiment of the invention the bending unit has a first normal working position at the level of the working surface, a possible second position of total or partial retraction below the working surface and a third raised position above the working surface.

As is known, the bending unit makes the bend in its first normal working position, whereas the second downwardly retracted position is necessary to be able to carry out inversion of the bend (from anticlockwise to clockwise or viceversa).

The third raised working position enables bends to be made in the trailing ends of long steel bars or complex stirrups without the long bars or complex stirrups coming into contact with the shearing unit or the drawing and/or straightening assembly located immediately upstream of the bending unit. When the bending unit is in its third raised position, the downstream drawing unit is located in its first normal working position at the level of the working surface, while the steel bar being processed bends owing to its flexibility and cooperates with the drawing unit downstream.

According to a variant the downstream drawing unit has a third position raised above the working surface at a level which corresponds advantageously with the level of the third raised position of the bending unit.

In this way, when the bending unit is in its third raised position, the drawing unit too is in its third raised position, so that the steel bar cooperates in a linear manner with the drawing unit and bending unit. This variant is especially suitable for bars of a great diameter which are not very flexible.

The positioning of the drawing unit and bending unit can be accomplished either with a three-positional jack or with a threaded bolt or with other means suitable for the purpose.

According to a second embodiment of the invention the bending-shaping machine according to the invention comprises gripping and guide elements located downstream of the bending unit and on the same axis as the section being processed.

These gripping and guide elements have a second normal working position at the level of the working surface, a first downwardly retracted position and a third position raised above the working surface.

The gripping and guide elements have a first position for clamping the section and a second position for semi-clamping the section, with the section able to slide axially and being guided by the gripping and guide elements.

The main purpose of these gripping and guide elements is to raise the section above the shearing unit and above the drawing and/or straightening assembly positioned upstream of the bending unit.

Thus, the bending unit takes up its third raised position and can make bends in the trailing end of the section without causing contact with the shearing unit and the drawing and/or straightening assembly.

During the bending step the gripping and guide elements can stay in their third raised position or be placed in their second normal working position.

According to a variant the bending-shaping machine according to the invention comprises suitable supporting and guide means to support the section and convey it in the right direction in cooperation with the drawing unit downstream.

These supporting and guide means too have a first normal working position, a second downwardly retracted position and a third position raised above the working surface.

BRIEF DESCRIPTION OF THE DRAWINGS

The attached figures, which are given as a non-restrictive example, show two embodiments of the invention as follows:

FIGS. 1*a*, 1*b*, 2*a*, 2*b*, 3*a*, 3*b*, 4*a*, 4*b*, 5*a*, 5*b*, 6*a*, 6*b*, 7*a* and 7*b* are diagrams of a bending cycle according to a first embodiment of the invention in which FIGS. 1*a*, 2*a*, 3*a*, 4*a*, 5*a*, 6*a* and 7*a* show a front view of a bending-shaping machine according to the invention, whereas FIGS. 1*b*, 2*b*, 3*b*, 4*b*, 5*b*, 6*b* and 7*b* show the relative cross sections;

FIGS. 8*a*, 8*b*, 9*a*, 9*b*, 10*a*, 10*b*, 11*a*, 11*b*, 12*a*, 12*b*, 13*a*, 13*b*, 14*a* and 14*b* are diagrams of a bending cycle according to a second embodiment of the invention, in which FIGS. 8*a*, 9*a*, 10*a*, 11*a*, 12*a*, 13*a* and 14*a* show a front view of a bending-shaping machine according to the invention, whereas FIGS. 8*b*, 9*b*, 10*b*, 11*b*, 12*b*, 13*b* and 14*b* show the relative cross sections.

DETAILED DESCRIPTION OF THE PREFERRED EMBODIMENTS

Figure 1A:
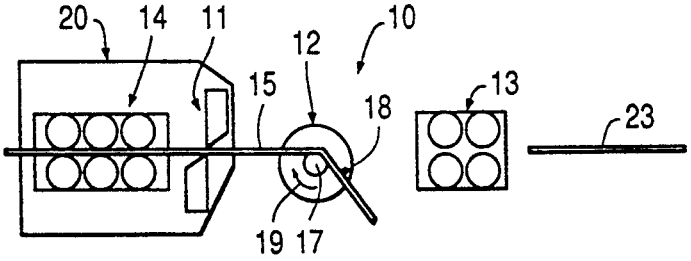

A bending-shaping machine 10 of this invention comprises a shearing unit 11, a bending unit 12, a drawing and/or straightening assembly 14 positioned upstream of the bending unit 12, and a drawing unit 13 positioned downstream of the bending unit 12.

In this case the bending unit 12 comprises a bending disk 19 to which an abutment roll 17 and bending pin 18 are secured; the bending unit 12 is normally located downstream of and near to the shearing unit 11.

The shearing unit 11 is connected laterally by a curved surface to a working surface 16.

The shearing unit 11 and the drawing and/or straightening assembly 14 are positioned within a protective cover 20 of a known type.

The bending unit 12 according to the invention has a first normal working position 12N level with the working surface 16, a second retracted position 12S below the working surface 16 and a third raised position 12A above the working surface 16.

In this example the drawing unit 13 too has three positions, namely a first normal working position 13N level with the working surface 16, a second downwardly retracted position 13S and a third raised position 13A.

The shearing unit 11 according to the invention advantageously has only one single working position.

Figure 1B:
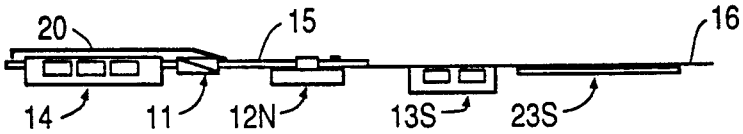

In FIGS. 1*a* and 1*b* the drawing and/or straightening assembly 14 positions a section 15 in a required position and the bending unit 12 makes a first bend in the leading end of the section 15, while the downstream drawing unit 13 is in its second retracted position 13S so as not to come into contact with the section 15 while the latter is being bent and is being fed fowards by the drawing and/or straightening assembly 14.

Thereafter the drawing and/or straightening assembly 14 displaces the section 15 containing its first bend forwards by a desired length.

Next, the bending unit 12 is displaced to its second retracted position 12S (not shown), in which it is moved sideways in a known manner to enable the abutment roll 17 to be positioned on the other side of the section 15 so as to make an inverted bend.

Figure 2A:
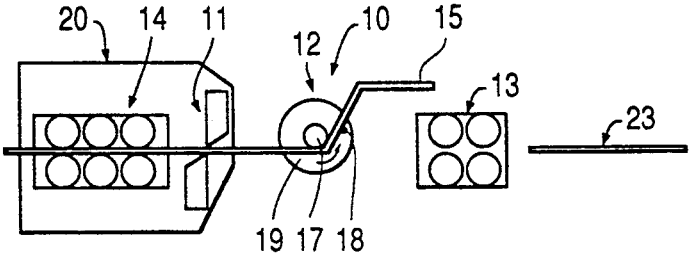
Figure 2B:
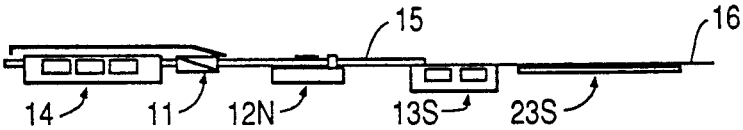

The bending unit 12 is then re-positioned (FIGS. 2*a* and 2*b*) in its first normal working position 12N and makes the second bend, an anticlockwise bend in this case, in the leading end of the section 15.

Figure 3A:
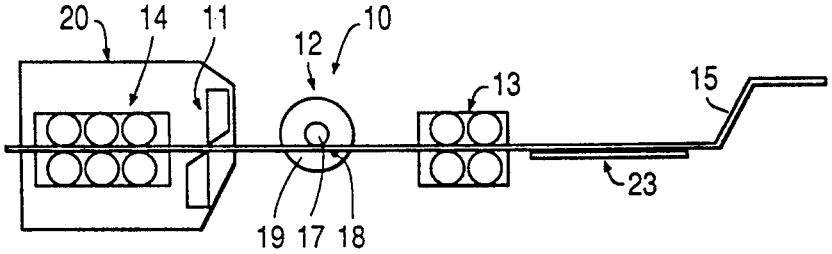
Figure 3B:
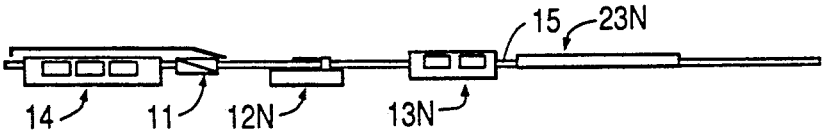

FIGS. 3*a* and 3*b* show the drawing and/or straightening assembly 14, which feeds the section 15 forwards by a required length; next, the downstream drawing unit 13 takes up its first normal working position 13N and grips the section 15 30 (FIG. 3*b*).

The bending-shaping machine 10 according to the invention comprises also a supporting channel 23 to support the section 15. This supporting channel 23 can take up a first normal working position 23N, a second downwardly retracted position 23S, and a third raised position 23A.

While the bends are made in the leading end of the section 15, the supporting channel 23 lies in its second retracted position 23S so as not to come into contact with the section 15 being processed.

In this step of the disclosed bending cycle the supporting channel 23 (FIGS. 3*a* and 3*b*) is moved from its second retracted position 23S to its first normal working position 23N.

Next, the shearing unit 11 shears the section 15 to size, the section 15 being gripped by the downstream drawing unit 13.

Figure 4A:
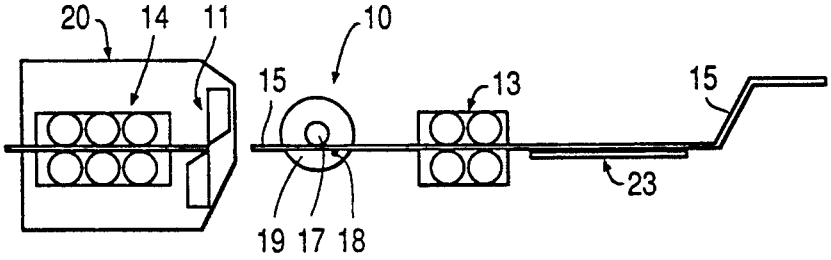
Figure 4B:
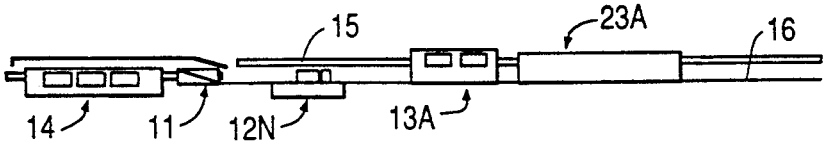

After the section 15 has been sheared to size, the downstream drawing unit 13 feeds the sheared section 15 forwards by a desired length so as to prevent contact with the shearing unit 11 (FIGS. 4*a* and 4*b*).

Figure 5A:
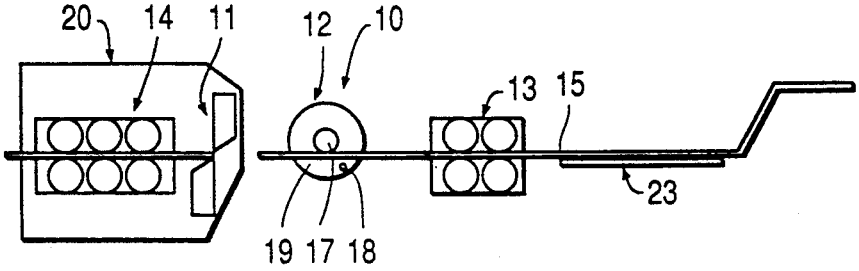
Figure 5B:
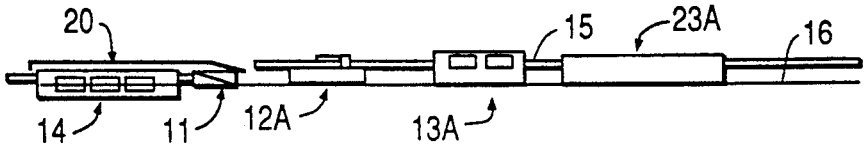

Next, the downstream drawing unit 13 is positioned in its third raised position 13A (FIG. 4*b*) and the bending unit 12 is positioned in its third raised position 12A (FIG. 5*b*).

Figure 5C:
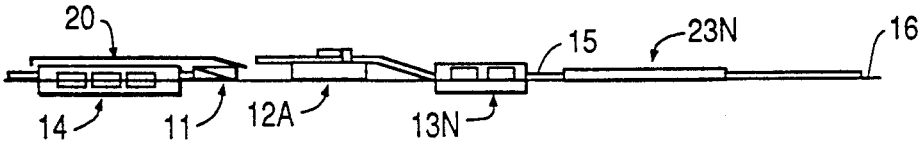
FIG. 5*c* shows a variant of the lay-out of FIG. 5*b*.

According to the variant of FIG. 5*c* the downstream drawing unit 13 has only two positions, namely a first normal working position 13N level with the working surface 16 and a second downwardly retracted position 13S. In such a case the section 15 being processed cooperates with the bending unit 12 in the third raised position 12A of the latter 12 and with the drawing unit 13 in the first normal working position 13N of the latter 13 owing to the flexibility of the section 15. This variant is especially suitable for sections 15 having a small cross section.

In continuation of the description of the bending cycle according to the invention, the downstream drawing unit 13 displaces the section 15 upstream by a desired length.

Figure 6A:
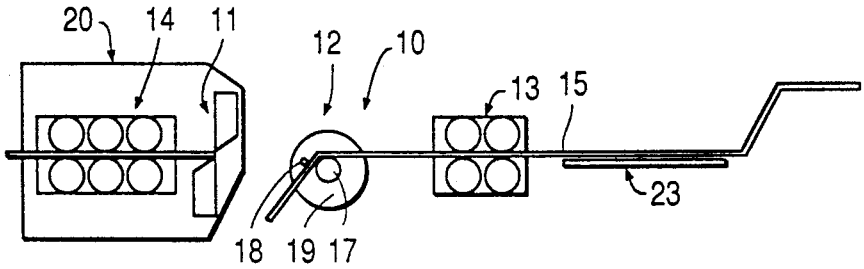
Figure 6B:
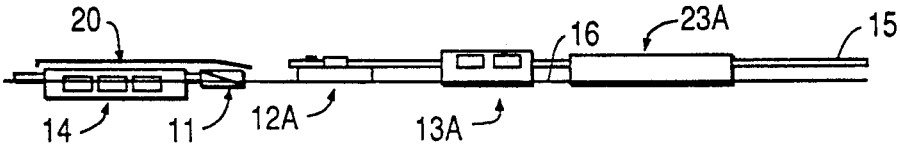

The bending unit 12 now makes the first bend in the trailing end of the section 15 without the section 15 coming into contact with the shearing unit 11 and drawing and/or straightening assembly 14 (FIGS. 6*a* and 6*b*).

Thereafter the downstream drawing unit 13 displaces the section 15 upstream again by a desired length without the section 15 coming into contact with the units or assemblies upstream of the bending unit 12.

Figure 7A:
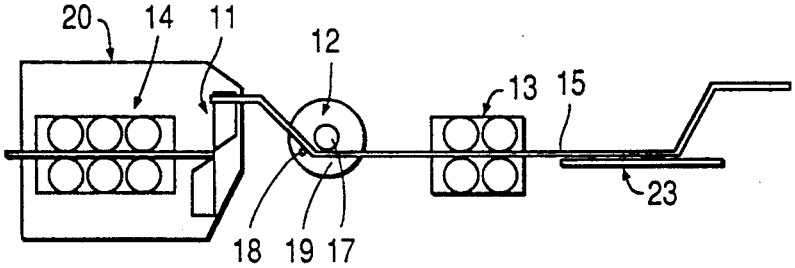
Figure 7B:
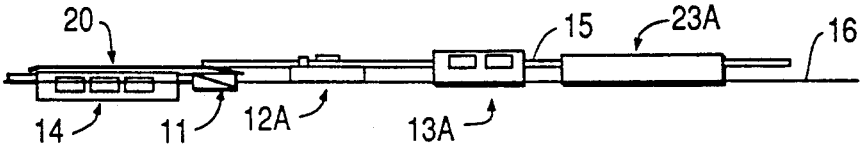

Next, the bending unit 12 in its raised position 12A makes the second bend in the trailing end of the section 15 without the section 15 coming into contact with the shearing unit 11 and the drawing and/or straightening assembly 14 (FIGS. 7*a* and 7*b*).

FIGS. 8 to 14 show a second embodiment of the invention.

Figure 8A:
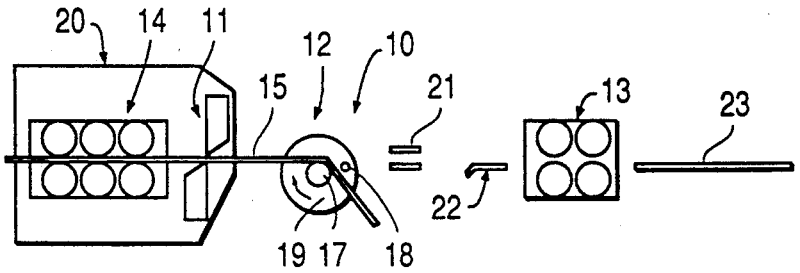
Figure 8B:
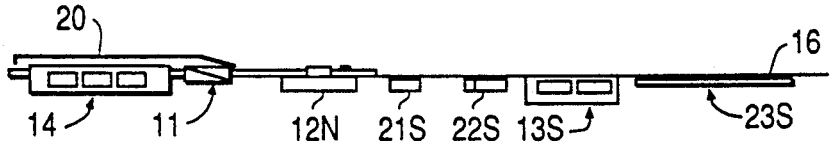

FIGS. 8*a* and 8*b* show a step in which, after the section 15 has been fed forwards by a required length by the drawing and/or straightening assembly 14, the bending unit 12 makes a first bend, a clockwise bend in this case, in the leading end of the section 15.

In this step the downstream drawing unit 13 is in its second retracted position 13S, while the bending unit 12 is in its first normal working position 12N.

According to this second embodiment the bending-shaping machine 10 comprises a gripping and guide element 21, which can take up a second normal working position 21N, a first downwardly retracted position 21S and a third raised position 21A.

In this example a supporting switch 22 and a supporting channel 23 are also comprised and can take up first normal working positions 22N–23N and second downwardly retracted positions 22S–23S.

During the making of the first bend in the leading end of the section 15 (FIGS. 8*a* and 8*b*) the gripping and guide element 21, the supporting switch 22 and the supporting channel 23 are in their respective retracted positions 21S–22S and 23S so as not to hinder the making of the first bend in the leading end of the section 15.

Next, the drawing and/or straightening assembly 14 feeds the section 15 forward by the required length.

The bending unit 12, after having taken up its second retracted position 12S (not shown) so as to enable the abutment roll 17 to be transferred sideways, takes up its first normal working position 12N to make the second bend in the leading end of the section 15.

Figure 9A:
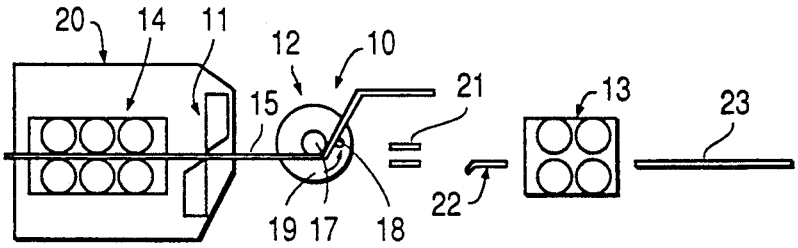
Figure 9B:
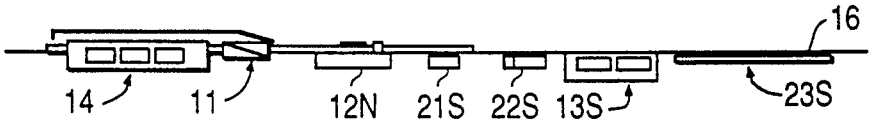

FIGS. 9*a* and 9*b* show the section 15, which has undergone the second bend in its leading end, an anticlockwise bend in this case.

During this step the downstream drawing unit 13 is in its second retracted position 13S; the gripping and guide element 21, the supporting switch 22 and the supporting channel 23 are also in their respective retracted positions 21S–22S–23S so as not to hinder the making of the second bend in the leading end of the section 15.

After the making of these two bends, which may consist of one or more bends, in its leading end the section 15 is fed forwards by a desired length by the drawing and/or straightening assembly 14, while the downstream drawing unit 13 and the gripping and guide element 21 are in their retracted positions 13S–21S and the supporting switch 22 is in its normal working position 22N so as to support the section 15.

Figure 10A:
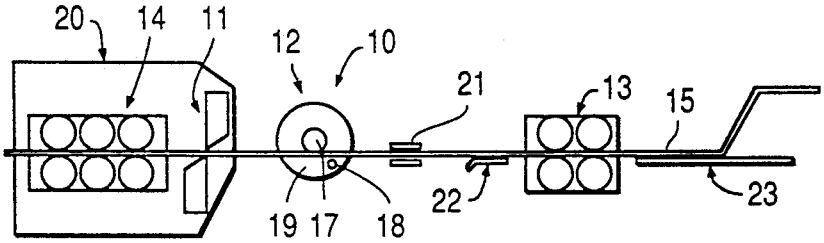
Figure 10B:
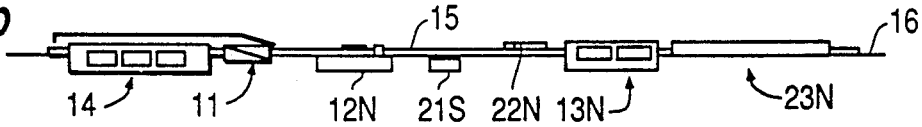
Figure 11A:
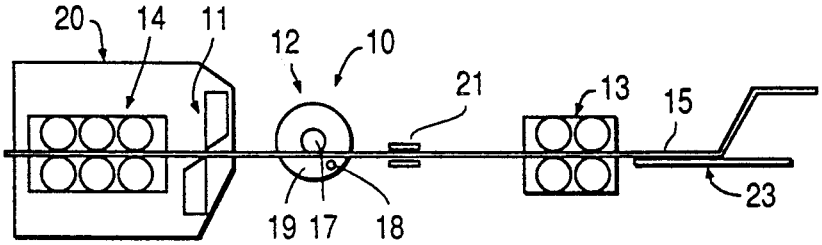
Figure 11B:
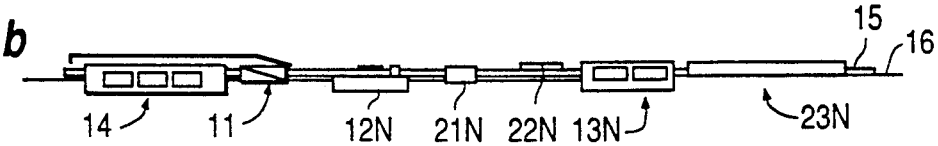

The section 15, when it has been fed forwards by the desired length, cooperates with the downstream drawing unit 13, which has taken up its first normal working position 13N (FIGS. 10*a* and 10*b*).

The supporting channel 23, after it has been surpassed by the bent leading portion of the section 15, can take up its normal working position 23N so as to support the section 15.

The gripping and guide element 21 now takes up its second normal working position 21N and grips the section 15 (FIGS. 11*a* and 11*b*); the section 15 is then sheared to size.

Figure 12A:
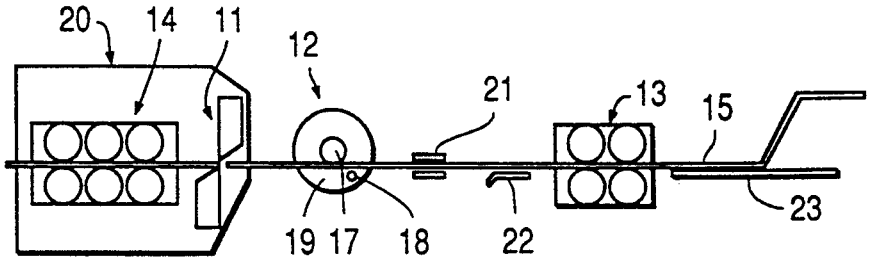
Figure 12B:
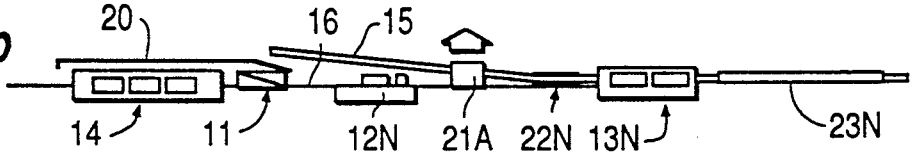

The section 15 is then fed forwards by the downstream drawing unit 13 by a required length suitable to prevent contact with the shearing unit 11 during the next step (FIGS. 12*a* and 12*b*).

The gripping and guide element 21 now takes up its third raised position 21A (FIG. 12*b*) and compels the section 15 to be raised above the upstream protective cover 20 to a position beyond the shearing unit 11.

Figure 13A:
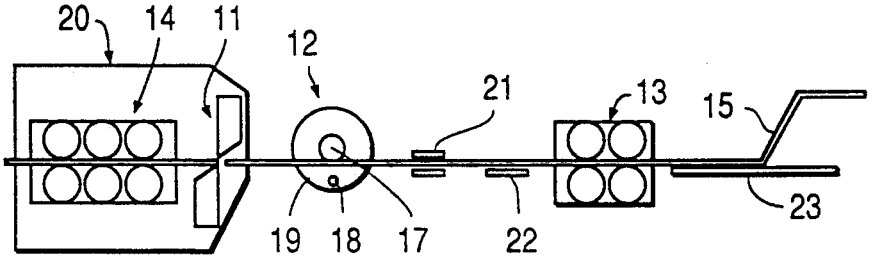
Figure 13B:
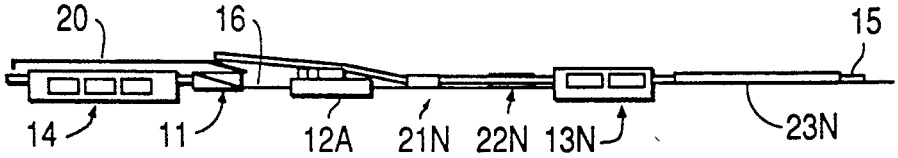

Thereafter the downstream drawing unit 13 is actuated and displaces the section 15 upstream by a desired length, while the gripping and guide element 21 is in its raised but not clamping position 21A so as to enable the section 15 to slide; next, the bending unit 12 is displaced to its raised position 12A, while the gripping and guide element 21 takes up its normal working position 21N and clamps the section 15, thus ensuring that the section 15 is positioned on the bending unit 12 and also maintaining a position of contact with the working surface 16 (FIGS. 13*a* and 13*b*).

The bending unit 12 is then actuated and makes a bend, a clockwise bend in this case, in the trailing end of the section 15 without the section 15 coming into contact with the shearing unit 11 or with the drawing and/or straightening assembly 14.

Figure 14A:
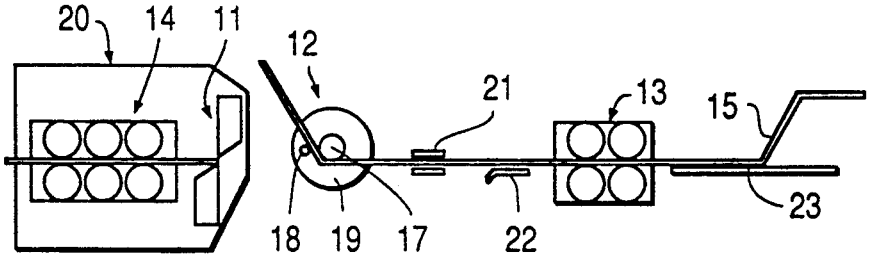
Figure 14B:
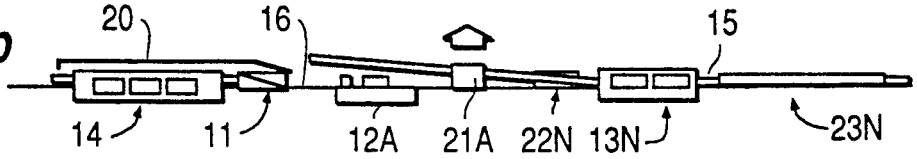

The bending unit 12 takes up again its first normal working position 12N, and the gripping and guide element 21 takes up its raised position 21A so as to assist disengagement of the section 15 from the abutment roll 17 and bending pin 18 and then takes up again a position suitable for a further upstream displacement of the section 15 by the downstream drawing unit 13 (FIGS. 14*a* and 14*b*).

The downstream drawing unit 13 and the gripping and guide element 21, after all the bends in the trailing end of the section 15 have been made, take up their relative retracted positions 13S and 21S.

According to a variant which is not shown the supporting switch 22 can take up a third raised position 22A so as to support the section 15 also in steps in which the gripping and guide element 21 is in its raised position 21A and the downstream drawing unit 13 is displacing the section 15.

We claim:

1. A bending-shaping machine having a working surface for bending sections passing therethrough from an upstream end to a downstream end, comprising:

an assembly for drawing and/or straightening a section;

an intermittently operated bending unit, provided downstream of said assembly, for bending said section;

a shearing unit provided between said assembly and said bending unit, for shearing said section;

a downstream drawing unit, provided downstream of said bending unit, for drawing said section, said downstream drawing unit having a first normal working position level with said working surface and second retracted positioned below said working surface, said first normal working position permitting drawing of said section by said drawing unit away from said bending unit and said second retracted position allowing for movement of said section over said downstream drawing unit without interference therebetween;

wherein said bending unit is movable between a first normal working position level with said working surface, a second retracted position below said working surface and a third raised working position above said working surface for raising said section above a level of said assembly and said shearing unit facilitating bending of said section without interference with said assembly and said shearing unit, said second retracted position permitting movement of said section over said bending unit without contact thereto.

2. Bending-shaping machine as claimed in claim 1, in which the downstream drawing unit has a third raised working position coordinated with the third raised working position of the bending unit.

3. Bending-shaping machine as claimed in claim 1, which comprises between the bending unit and the downstream drawing unit at least one gripping and guide element having a second normal working position, a first downwardly retracted position and a third raised position.

4. Bending-shaping machine as claimed in claim 3, in which the at least one gripping and guide element at least in either its second normal working position or its third raised position has a first position of clamping the section and a second position of semiclamping the section so as to permit axial sliding of the section.

5. Bending-shaping machine as claimed in claim 3, which comprises upstream of the downstream drawing unit supporting and guide means having at least a first normal working position, a second downwardly retracted position.

6. Bending-shaping machine as claimed in claim 1, which comprises downstream of the downstream drawing unit supporting means having a first normal working position, a second downwardly retracted position, and a third raised position.

7. Bending-shaping machine as claimed in claim 5, wherein said supporting and guide means has a third raised position.

8. Bending-shaping machine as claimed in claim 1, wherein said bending unit comprises a rotatable bending disk having an abutment roll provided on an axis of rotation of said bending disk and a bending pin for bending said section about said abutment roll.

9. Bending-shaping machine as claimed in claim 1, wherein said working surface can be oriented in any plane from horizontal to vertical.

* * * * *